US010389045B2

(12) United States Patent
Nishiyama

(10) Patent No.: US 10,389,045 B2
(45) Date of Patent: Aug. 20, 2019

(54) ELECTRICAL COAXIAL CONNECTOR

(71) Applicant: DAI-ICHI SEIKO CO., LTD., Kyoto (JP)

(72) Inventor: Kohei Nishiyama, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 16/189,757

(22) Filed: Nov. 13, 2018

(65) Prior Publication Data

US 2019/0190169 A1 Jun. 20, 2019

(30) Foreign Application Priority Data

Dec. 19, 2017 (JP) ..... 2017-242713
Oct. 22, 2018 (JP) ..... 2018-198073

(51) Int. Cl.
*H01R 9/05* (2006.01)
*H01R 24/40* (2011.01)

(52) U.S. Cl.
CPC ..... *H01R 9/0512* (2013.01); *H01R 9/0524* (2013.01); *H01R 24/40* (2013.01)

(58) Field of Classification Search
CPC .... H01R 9/0512; H01R 9/0524; H01R 24/40; H01R 24/50
USPC ..... 439/578
See application file for complete search history.

(56) References Cited

U.S. PATENT DOCUMENTS 9,011,163 B2 * 4/2015 Ohsaka ..... H01R 13/40 439/63
9,236,670 B2 * 1/2016 Nishikawa ..... H01R 9/0518
9,236,696 B2 * 1/2016 Nishikawa ..... H01R 9/0518
9,509,106 B2 * 11/2016 Nakamura ..... H01R 24/50
2009/0208168 A1 * 8/2009 Ishikawa ..... H01R 13/113 385/14
2013/0115810 A1 * 5/2013 Maruyama ..... H01R 24/50 439/578
2016/0028198 A1 * 1/2016 Yamashita ..... H01R 24/40 439/345
2018/0212363 A1 * 7/2018 Fukumoto ..... H01R 24/40
2018/0277989 A1 * 9/2018 Hashiguchi ..... H01R 13/502

FOREIGN PATENT DOCUMENTS

JP 2005-183212 A 7/2005
JP 2015-207350 A 11/2015
JP 2018-116908 A 7/2018

* cited by examiner

*Primary Examiner* — Alexander Gilman
(74) *Attorney, Agent, or Firm* — Studebaker & Brackett PC

(57) ABSTRACT

An electrical coaxial connector comprising a connector body including a signal contact member, a grounding contact member and a housing member for supporting the signal contact member and the grounding contact member, and a locking component made to be separate from the connector body for engaging detachably with the grounding contact member, wherein the locking component is provided thereon with a displaceable engaging portion which is operative to lock an annular engaging portion of the grounding contact member from the outside of the same at a position for closing partially a slit provided on the annular engaging portion when the locking component is caused to engagement with the grounding contact member, so that the annular engaging portion of the grounding contact member is prevented from being subjected to expanding deformation to widen the slit.

10 Claims, 13 Drawing Sheets

ELECTRICAL COAXIAL CONNECTOR

BACKGROUND OF THE INVENTION

Field of the Invention

The present invention relates generally to an electrical coaxial connector, and more particularly to an improvement in an electrical coaxial connector which has a signal contact member and a grounding contact member insulated from each other to be connected respectively with a core conductor and an outer conductor of a coaxial cable which is provided with an internal insulator put between the core conductor and the outer conductor for surrounding the core conductor and an external insulator for surrounding the outer conductor, and is used to be coupled mechanically and electrically with a mating coaxial connector fixed, for example, to a circuit board.

Description of the Prior Art Including Information Disclosed Under 37 CFR 1.97 and 37 CFR 1.98

There has been often utilized a coaxial cable which has a core conductor, an outer conductor, an internal insulator put between the core conductor and the outer conductor for surrounding the core conductor, and an external insulator for surrounding the outer conductor, for transmitting high-frequency signals between electrical parts, electric equipments or electronic apparatus. The coaxial cable constitutes usually a signal transmission path insulated from the influence of external noises and the high-frequency signal transmitted through the coaxial cable is put in a condition of electro-magnetic shield so as to be inactive to leak out from the core conductor or to prevent noises from mixing thereinto from the outside. For example, the coaxial cable is connected with a circuit board on which high frequency signals are dealt with and the high frequency signal is transmitted through the coaxial cable from the circuit board to the outside or from the outside to the circuit board under the condition of electro-magnetic shield.

For connecting the coaxial cable with the circuit board, an electrical coaxial connector is mounted on an end of the coaxial cable to be coupled mechanically and electrically with a mating coaxial connector fixed to the circuit board. The electrical coaxial connector mounted on the end of the coaxial cable (hereinafter, referred to as a coaxial cable connector) has a signal contact member with which the core conductor of the coaxial cable is connected and a grounding contact member with which the outer conductor of the coaxial cable is connected. The mating coaxial connector has a central contact to which the high-frequency signal dealt with on the circuit board is supplied and an annular grounding contact provided for surrounding the central contact member to be supplied with a ground potential. When the coaxial cable connector is coupled mechanically and electrically with the mating coaxial connector on the circuit board, the grounding contact member of the coaxial cable connector engages with the annular grounding contact of the mating coaxial connector to be electrically connected with the same and the signal contact member of the coaxial cable connector comes into press-contact with the central contact of the mating coaxial connector to be electrically connected with the same.

For such a mechanical and electrical coupling of the coaxial cable connector with the mating coaxial connector as mentioned above, the mating coaxial connector is fixed to the circuit board with the central contact and the annular grounding contact surrounding the central contact each facing upward on a parts-mountable surface of the circuit board on which various electrical or electronic parts are mounted, so that the coaxial cable connector is moved downward toward the parts-mountable surface of the circuit board to be coupled with the mating coaxial connector in such a manner that the grounding contact member of the coaxial cable connector is engaged with the annular grounding contact of the mating coaxial connector and the signal contact member of the coaxial cable connector is put in press-contact with the central contact of the mating coaxial connector. As a result, the coaxial cable connector coupled mechanically and electrically with the mating coaxial connector which is fixed to the circuit board is postured to project from the parts-mountable surface of the circuit board with a predetermined measure of thickness in a direction perpendicular to the parts-mountable surface of the circuit board.

Under a condition wherein the coaxial cable connector is coupled mechanically and electrically with the mating coaxial connector in such a manner as described above, it is desired that the mechanical and electrical coupling of the coaxial cable connector with the mating coaxial connector is surely maintained without causing the coaxial cable connector to be removed undesirably from the mating coaxial connector. Accordingly, there has been previously proposed a pair of coaxial cable connector and mating coaxial connector provided with a rocking mechanism for preventing the coaxial cable connector from releasing undesirably a mechanical and electrical coupling with the mating coaxial connector, as disclosed in, for example, the Japanese patent application published before examination under publication number 2005-183212 (hereinafter, referred to as a published prior art document).

The previously proposed coaxial cable connector (a coaxial connector (10)) disclosed in the published prior art document comprises a signal contact member (a terminal (13)) connected with a core conductor (a core line (C1)) of a coaxial cable (a cable (C)), a grounding contact member (an external conductor (11)) connected with an outer conductor (a shielding mesh (C2)) of the coaxial cable, and an insulating housing member (a dielectric member (12)) for holding the signal contact member and the grounding contact member in such a manner that the signal contact member and the grounding contact member are insulated from each other. The previously proposed mating coaxial connector (a mating coaxial connector (60)) disclosed also in the published prior art document comprises a signal contact (a central conductor (62)) connected with a signal terminal provided on a circuit board, an annular grounding contact (an external conductor (61)) surrounding a contact-connecting portion (a contacting portion (62A)) of the signal contact, and an insulating housing (a dielectric member (63)) for holding the signal contact and the annular grounding contact in such a manner that the signal contact and the annular grounding contact are insulated from each other.

When the previously proposed coaxial cable connector is coupled mechanically and electrically with the previously proposed mating coaxial connector, an annular engaging portion (14) of the grounding contact member of the previously proposed coaxial cable connector engages with the annular grounding contact of the previously proposed mating coaxial connector to be electrically connected with the same and a contacting portion (25) of the signal contact member of the previously proposed coaxial cable connector comes into contact with the contact-connecting portion of the signal contact of the previously proposed mating coaxial connector to be electrically connected with the same.

The annular engaging portion (14) of the grounding contact member of the previously proposed coaxial cable connector is formed by means of curving a metallic plate to be annular component and provided on a curved inner surface thereof with an annular projection (14B) elongating in a circumference direction of the curved inner surface for constituting a rocking portion. The annular grounding contact of the previously proposed mating coaxial connector is provided on a curved outer surface thereof with an annular rocking groove (61A). An inside diameter of the annular projection (14B) provided on the curved inner surface of the annular engaging portion (14) of the grounding contact member of the previously proposed coaxial cable connector is selected to be smaller than an outside diameter of the annular grounding contact of the previously proposed mating coaxial connector provided on the curved outer surface thereof with the annular rocking groove (61A).

When the annular engaging portion (14) of the grounding contact member of the previously proposed coaxial cable connector is engaged with the annular grounding contact of the previously proposed mating coaxial connector under a condition wherein the previously proposed coaxial cable connector is coupled mechanically and electrically with the previously proposed mating coaxial connector, the annular projection (14B) provided on the curved inner surface of the annular engaging portion (14) of the grounding contact member of the previously proposed coaxial cable connector comes into engagement with the annular rocking groove (61A) provided on the curved outer surface of the annular grounding contact of the previously proposed mating coaxial connector, so that the annular engaging portion (14) of the grounding contact member of the previously proposed coaxial cable connector is prevented from releasing undesirably the mechanical and electrical coupling with the mating coaxial connector.

On the occasion of the engagement of the annular projection (14B) with the annular rocking groove (61A), first, the annular engaging portion (14) of the grounding contact member of the previously proposed coaxial cable connector is deformed to be enlarged with its resiliency so that the inside diameter of the annular projection (14B) provided on the curved inner surface of the annular engaging portion (14) of the grounding contact member of the previously proposed coaxial cable connector is temporally enlarged and the annular projection (14B) is put in contact with the curved outer surface of the annular grounding contact of the previously proposed mating coaxial connector. Then, the annular projection (14B) is caused to move along the curved outer surface of the annular grounding contact of the previously proposed mating coaxial connector so as to engage with the annular rocking groove (61A) provided on the curved outer surface of the annular grounding contact of the previously proposed mating coaxial connector. With the engagement of the annular projection (14B) with the annular rocking groove (61A), the inside diameter of the annular projection (14B) which has been temporally enlarged is caused to undo.

Under such a condition as mentioned above, the annular projection (14B) provided on the curved inner surface of the annular engaging portion (14) of the grounding contact member of the previously proposed coaxial cable connector and the annular rocking groove (61A) provided on the curved outer surface of the annular grounding contact of the previously proposed mating coaxial connector are operative to constitute the rocking mechanism for preventing the previously proposed coaxial cable connector from releasing undesirably the mechanical and electrical coupling with the previously proposed mating coaxial connector.

As described above, in the combination of the previously proposed coaxial cable connector and the previously proposed mating coaxial connector, the annular projection (14B) is provided on the curved inner surface of the annular engaging portion (14) of the grounding contact member of the previously proposed coaxial cable connector and the annular rocking groove (61A) is provided on the curved outer surface of the annular grounding contact of the previously proposed mating coaxial connector, and the inside diameter of the annular projection (14B) is selected to be smaller than the outside diameter of the annular grounding contact of the previously proposed mating coaxial connector provided on the curved outer surface thereof with the annular rocking groove (61A). Then, when the previously proposed coaxial cable connector is coupled mechanically and electrically with the previously proposed mating coaxial connector, the annular engaging portion (14) of the grounding contact member of the previously proposed coaxial cable connector is deformed to be enlarged with its resiliency so that the inside diameter of the annular projection (14B) provided on the curved inner surface of the annular engaging portion (14) is temporally enlarged so as to come into engagement with the annular rocking groove (61A) provided on the curved outer surface of the annular grounding contact of the previously proposed mating coaxial connector. On that occasion, the below-mentioned inconveniences accompanied with the selection of the inside diameter of the annular projection (14B) are brought about.

In the case wherein the inside diameter of the annular projection (14B) is so selected that a difference between the inside diameter of the annular projection (14B) and the outside diameter of the annular grounding contact of the previously proposed mating coaxial connector becomes relatively large, such an inconvenience that a considerably large operation force is required for causing the annular engaging portion (14) of the grounding contact member of the previously proposed coaxial cable connector to be so deformed that the inside diameter of the annular projection (14B) is temporally enlarged and to engage with the curved outer surface of the annular grounding contact of the previously proposed mating coaxial connector and then for causing the annular projection (14B) to come into engagement with the annular rocking groove (61A) provided on the curved outer surface of the annular grounding contact of the previously proposed mating coaxial connector, is invited. On the other hand, in the case wherein the inside diameter of the annular projection (14B) is so selected that the difference between the inside diameter of the annular projection (14B) and the outside diameter of the annular grounding contact of the previously proposed mating coaxial connector becomes relatively small, such an inconvenience that the annular projection (14B) is caused to come loosely into engagement with the annular rocking groove (61A) provided on the curved outer surface of the annular grounding contact of the previously proposed mating coaxial connector under the condition wherein the annular engaging portion (14) of the grounding contact member of the previously proposed coaxial cable connector is caused to engage with the curved outer surface of the annular grounding contact of the previously proposed mating coaxial connector, so that the annular engaging portion (14) caused to engage with the curved outer surface of the annular grounding contact of the previously proposed mating coaxial connector is so deformed undesirably that the inside diameter of the annular projection (14B) is temporally enlarged and cased to release easily the engagement with the curved outer surface of the annular grounding contact of the previously proposed mating coaxial connector, is invited.

BRIEF SUMMARY OF THE INVENTION

Accordingly, it is an object of the present invention to provide an electrical coaxial connector used to be coupled mechanically and electrically with a mating coaxial connector fixed to a circuit board, which comprises a signal contact member with which a core conductor of a coaxial cable is to be connected, a grounding contact member with which an outer conductor of the coaxial cable is to be connected, and a housing made of insulator for supporting the signal contact member and the grounding contact member in such a manner that the signal contact member and the grounding contact member are insulated from each other, and which avoids the aforementioned problems and disadvantages encountered with the prior art.

Another object of the present invention is to provide an electrical coaxial connector used to be coupled mechanically and electrically with a mating coaxial connector fixed to a circuit board, which comprises a signal contact member with which a core conductor of a coaxial cable is to be connected, a grounding contact member with which an outer conductor of the coaxial cable is to be connected, and a housing made of insulator for supporting the signal contact member and the grounding contact member in such a manner that the signal contact member and the grounding contact member are insulated from each other, and with which a mechanical and electrical coupling of the electrical coaxial connector with the mating coaxial connector can be surely maintained for preventing the electrical coaxial connector from removing undesirably from the mating coaxial connector without any considerably large operation force.

A further object of the present invention is to provide an electrical coaxial connector used to be coupled mechanically and electrically with a mating coaxial connector fixed to a circuit board, which comprises a signal contact member with which a core conductor of a coaxial cable is to be connected, a grounding contact member with which an outer conductor of the coaxial cable is to be connected, and a housing made of insulator for supporting the signal contact member and the grounding contact member in such a manner that the signal contact member and the grounding contact member are insulated from each other, and with which a mechanical and electrical coupling of the electrical coaxial connector with the mating coaxial connector can be surely maintained for preventing the electrical coaxial connector from removing undesirably from the mating coaxial connector with a relatively simple structure.

According to the present invention, as claimed in any one of accompanying claims, there is provided an electrical coaxial connector which comprises a connector body including a signal contact member with which a core conductor of a coaxial cable is to be connected and which is caused to be put in contact with a signal contact of a mating coaxial connector, a grounding contact member having an annular engaging portion for engaging with an annular grounding contact of the mating coaxial connector and a shell portion extending to be bendable from the annular engaging portion for coming into connection with an outer conductor of the coaxial cable having the core conductor connected with the signal contact member, and a housing member made of insulator for supporting the signal contact member and the grounding contact member in such a manner that the signal contact member and the grounding contact member are insulated from each other, and a locking component made to be separate from the connector body for engaging detachably with an outer peripheral surface of the annular engaging portion of the grounding contact member, wherein the annular engaging portion of the grounding contact member is provided thereon with a slit extending in a direction along an imaginary central axis of the annular engaging portion and further provided on a curved inner surface thereof with an engagement-acting portion for engaging with an engagement-receiving portion provided on a curved outer surface of the annular grounding contact of the mating coaxial connector, the locking component is provided thereon with a displaceable engaging portion which is able to move around the outer peripheral surface of the annular engaging portion of the grounding contact member when the locking component is caused to engage detachably with the outer peripheral surface of the annular engaging portion of the grounding contact member, and the displaceable engaging portion of the locking component is operative to lock the annular engaging portion of the grounding contact member from the outside of the same at a position for closing partially the slit provided on the annular engaging portion of the grounding contact member, so that the annular engaging portion of the grounding contact member is prevented from being subjected to expanding deformation to widen the slit.

As for the engagement-acting portion provided on the curved inner surface of the annular engaging portion of the grounding contact member and the engagement-receiving portion provided on the curved outer surface of the annular grounding contact of the mating coaxial connector, for example, one of the engagement-acting portion and the engagement-receiving portion is formed to be a protrusion and the other of the engagement-acting portion and the engagement-receiving portion is formed to be a groove with which the projection engages.

For example, the locking component is provided, in addition to the displaceable engaging portion, with a flat portion which is positioned to be close to or in contact with the shell portion of the grounding contact member bent toward the annular engaging portion of the grounding contact member when the locking component is engaged with the outer peripheral surface of the annular engaging portion of the grounding contact member under a condition wherein the shell portion of the grounding contact member has been bent toward the annular engaging portion of the grounding contact member, and a connecting portion for connecting the flat portion with the displaceable engaging portion. In such a case, the locking component is, for example, formed integrally by a metallic plate subjected to bending processing and the displaceable engaging portion of the locking component is, for example, formed to curve along the outer peripheral surface of the annular engaging portion of the grounding contact member.

Then, the locking component is, for example, further provided, in addition to the displaceable engaging portion, the flat portion and the connecting portion each described above, with a stopper portion projecting from the connecting portion. When the displaceable engaging portion of the locking component is caused to move around the outer peripheral surface of the annular engaging portion of the grounding contact member, the stopper portion is operative to engage with a portion of the grounding contact member so as to prevent the displaceable engaging portion from moving excessively along the outer peripheral surface of the annular engaging portion of the grounding contact member.

In such a case, the locking component is, for example, made integrally of metallic material subjected to cutting processing.

As described above, the electrical coaxial connector according to the present invention includes the connector body which has the signal contact member and the grounding contact member supported by the housing made of insulator to be isolated from each other and the locking component made to be separate from the conductor body. In the connector body, the signal contact member is provided to be connected with the core conductor of the coaxial cable and the grounding contact member is provided to be connected with the outer conductor of the coaxial cable.

The grounding contacting member employed in the connector body is provided with the annular engaging portion for engaging with the annular grounding contact of the mating coaxial connector and the shell portion extending to be bendable from the annular engaging portion for coming into connection with the outer conductor of the coaxial cable having the core conductor connected with the signal contact member of the connector body. The annular engaging portion of the ground contacting member employed in the connector body is provided thereon the slit extending in the direction of the imaginary central axis of the annular engaging portion and further provided on the curved inner surface thereof with the engagement-acting portion for engaging with the engagement-receiving portion provided on the curved outer surface of the annular grounding contact of the mating coaxial connector with which the annular engaging portion of the grounding contact member engages.

The locking component is provided for engaging detachably with the outer peripheral surface of the annular engaging portion of the grounding contact member employed in the connector body and has the displaceable engaging portion which is able to move around the outer peripheral surface of the annular engaging portion of the grounding contact member when the locking component is caused to engage detachably with the outer peripheral surface of the annular engaging portion of the grounding contact member. The displaceable engaging portion of the locking component is operative to lock the annular engaging portion of the grounding contact member from the outside of the same at the position for closing partially the slit provided on the annular engaging portion of the grounding contact member, so that the annular engaging portion of the grounding contact member is prevented from being subjected to expanding deformation to widen the slit.

Under such a situation, when the annular engaging portion of the grounding contact member employed in the contact body is caused to engage with the annular ground contact of the mating coaxial connector, the engagement-acting portion provided on the curved inner surface of the annular engaging portion of the grounding contact member comes into engagement with the engagement-receiving portion provided on the curved outer surface of the annular grounding contact employed in the mating coaxial connector, and then the shell portion of the grounding contact member of the contact body is bent toward the annular engaging portion of the grounding contact member. After that, the locking component is caused to engage detachably with the outer peripheral surface of the annular engaging portion of the grounding contact member employed in the connector body and the displaceable engaging portion of the locking component is caused to take the position for closing partially the slit provided on the annular engaging portion of the grounding contact member.

The displaceable engaging portion of the locking component thus taking the position for closing partially the slit provided on the annular engaging portion of the grounding contact member employed in the connector body, operates to lock the annular engaging portion of the grounding contact member from the outside of the same so that the annular engaging portion of the grounding contact member is prevented from being subjected to expanding deformation to widen the slit when an undesirable external force acts on the annular engaging portion of the grounding contact member put in engagement with the annular grounding contact of the mating coaxial connector for causing the annular engaging portion of the grounding contact member to remove from the annular ground contact of the mating coaxial connector.

When the annular engaging portion of the grounding contact member employed in the connector body is caused to release the engagement with the annular ground contact employer in the mating coaxial connector so as to be able to remove from the annular grounding contact of the mating coaxial connector, it is necessary that the annular engaging portion of the grounding contact member is subjected to expanding deformation to widen the slit provided thereon so that the engagement-acting portion provided on the curved inner surface of the annular engaging portion of the grounding contact member is disengaged from the engagement-receiving portion provided on the curved outer surface of the annular grounding contact employed in the mating coaxial connector. In the combination of the connector body and the locking component described above, since the displaceable engaging portion of the locking component is operative to prevent the annular engaging portion of the grounding contact member from being subjected to the expanding deformation to widen the slit, the annular engaging portion of the grounding contact member employed in the connector body caused to engage with the annular grounding contact employed in the mating coaxial connector is continuously maintained in a desirable condition wherein the engagement-acting portion provided on the curved inner surface of the annular engaging portion of the grounding contact member is stably put in engagement with the engagement-receiving portion provided on the curved outer surface of the annular grounding contact employed in the mating coaxial connector.

That is, the annular engaging portion of the grounding contact member employed in the connector body is operative to keep continuously the engagement with the annular grounding contact employed in the mating coaxial connector even when the undesirable external force acts on the annular engaging portion of the grounding contact member put in engagement with the annular grounding contact employed in the mating coaxial connector for causing the annular engaging portion of the grounding contact member to remove from the annular grounding contact employed in the mating coaxial connector.

When the annular engaging portion of the grounding contact member employed in the connector body is caused intentionally to release the engagement with the annular grounding contact employed in the mating coaxial connector, first, the locking component is detached from the outer peripheral surface of the annular engaging portion of the grounding contact member, and then an appropriate external force is applied to the annular engaging portion of the grounding contact member for disengaging from the annular grounding contact employed in the mating coaxial connector. With the appropriate external force thus applied, the annular engaging portion of the grounding contact member is temporarily caused to deform for widening the slit provided thereon so that the engagement-acting portion provided on the curved inner surface of the annular engaging portion of the grounding contact member is caused to release the engagement with the engagement-receiving portion provided on the curved outer surface of the annular grounding contact employed in the mating coaxial connector and thereby the annular engaging portion of the grounding contact member is able to release the engagement with the annular grounding contact employed in the mating coaxial connector.

In the electrical coaxial connector thus constituted in accordance with the present invention, on the occasion of mechanical and electrical coupling with the mating coaxial connector fixed to the circuit board, the annular engaging portion of the grounding contact member employed in the connector body is caused to engage with the annular grounding contact employed in the mating coaxial connector and the locking component made to be separate from the connector body and provided thereon with the displaceable engaging portion is caused to engage with the outer peripheral surface of the annular engaging portion of the grounding contact member. Under such a situation, the displaceable engaging portion of the locking component is caused to take the position for closing partially the slit provided on the annular engaging portion of the grounding contact member for locking the annular engaging portion of the grounding contact member from the outside of the same so that the annular engaging portion of the grounding contact member is prevented from being subjected to expanding deformation to widen the slit. Thereby, the annular engaging portion of the grounding contact member employed in the connector body is operative to keep continuously the engagement with the annular grounding contact employed in the mating coaxial connector even when the undesirable external force acts on the annular engaging portion of the grounding contact member put in engagement with the annular grounding contact employed in the mating coaxial connector for causing the annular engaging portion of the grounding contact member to remove from the annular grounding contact employed in the mating coaxial connector. As a result, the mechanical and electrical coupling of the electrical coaxial connector according to the present invention with the mating coaxial connector can be surely and stably maintained.

The locking component provided with the displaceable engaging portion is, for example, formed integrally by the metallic plate subjected to bending processing or made integrally of the metallic material subjected to cutting processing, and this results in a relatively simple structure of the electrical coaxial connector according to the present invention.

Further, on the occasion of causing the displaceable engaging portion of the locking component put in engagement with the outer peripheral surface of the annular engaging portion of the grounding contact member employed in the connector body to take the position for closing partially the slit provided on the annular engaging portion of the grounding contact member, a relatively simple operation for moving the displaceable engaging portion of the locking component along the outer peripheral surface of the annular engaging portion of the grounding contact member is required without requiring a considerably large operation force.

Accordingly, with the electrical coaxial connector according to the present invention, when the electrical coaxial connector is mechanically and electrically coupled with the mating coaxial connector fixed to the circuit board to be put in practical use, the mechanical and electrical coupling of the electrical coaxial connector with the mating coaxial connector can be surely maintained for preventing the electrical coaxial connector from removing undesirably from the mating coaxial connector with the relatively simple structure without any considerably large operation force.

DETAILED DESCRIPTION OF THE INVENTION

Figure 1:
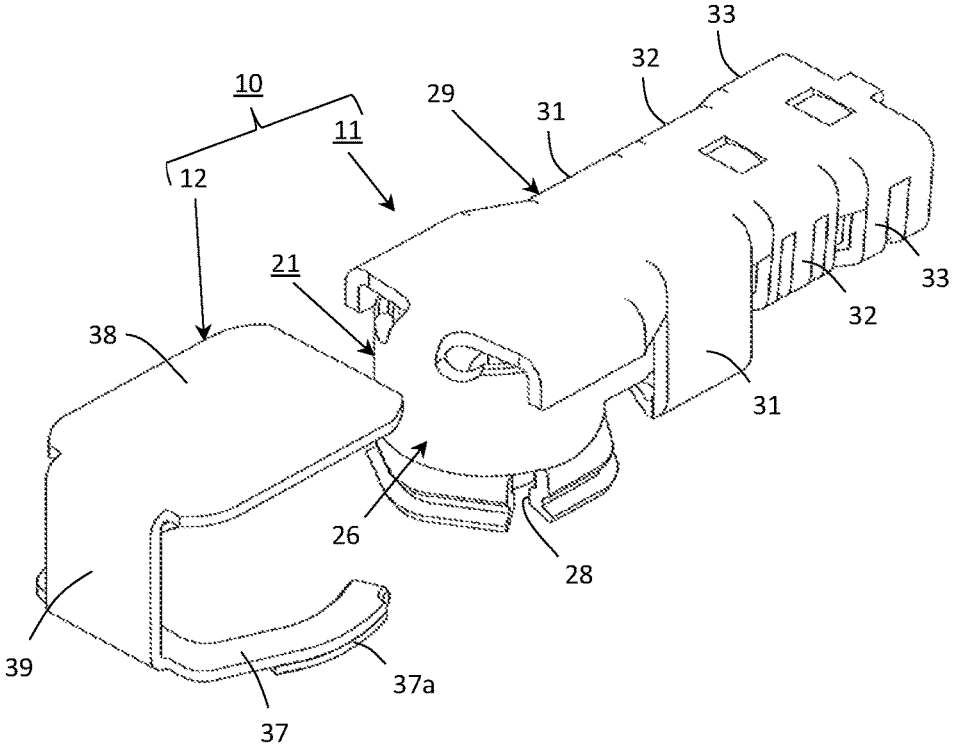
FIG. 1 is a schematic perspective view showing a first embodiment of electrical coaxial connector according to the present invention which comprises a connector body and a locking component.

FIG. 1 shows a first embodiment of electrical coaxial connector according to the present invention which is used to be mounted on an end portion of a coaxial cable and coupled with a mating coaxial connector.

Referring to FIG. 1, an electrical coaxial connector 10, which constitutes the first embodiment of electrical coaxial connector according to the present invention, comprises a connector body 11 and a locking component 12.

Figure 4:
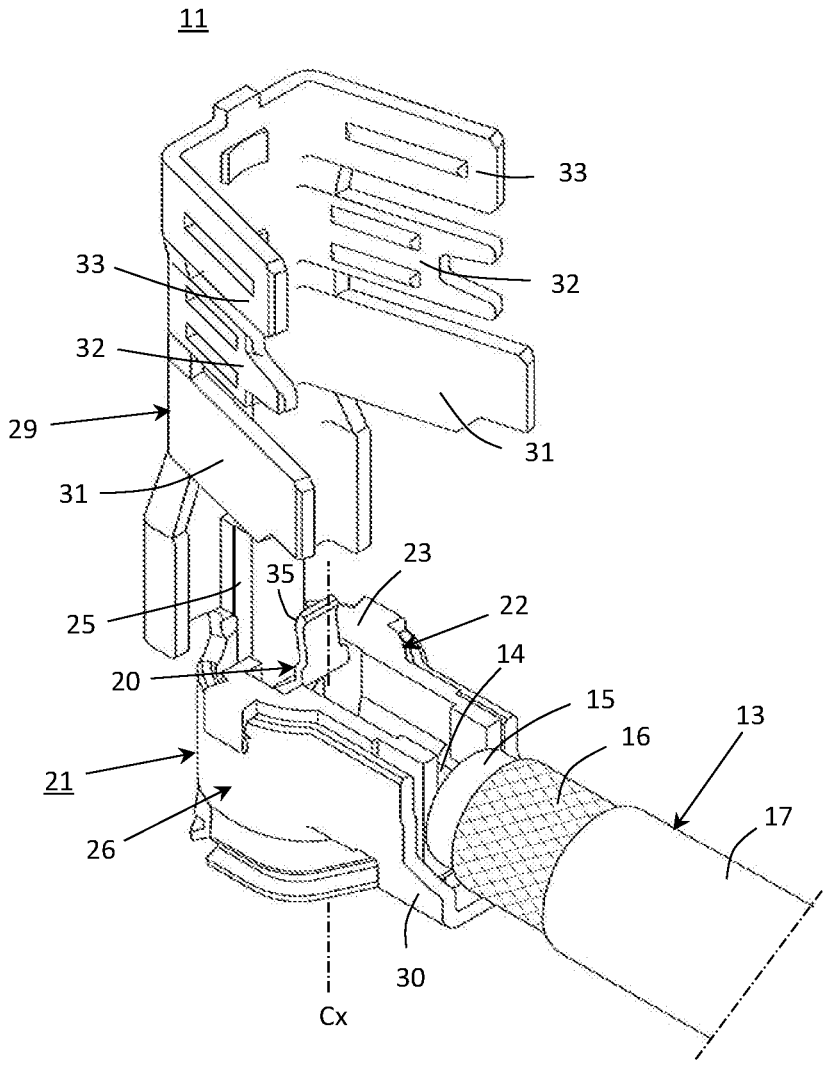
FIG. 4 is a schematic perspective view showing a process of mounting the connector body employed in the first embodiment of electrical coaxial connector according to the present invention on an end portion of a coaxial cable.

The connector body 11 is provided for being connected with the end portion of the coaxial cable. As shown in FIG. 4 explained later, a coaxial cable 13, with an end portion of which the connector body 11 is connected, has a core conductor 14, an inner insulator 15 surrounding closely the core conductor 14, an outer conductor 16 surrounding closely the inner insulator 15, and an outer insulator 17 surrounding closely the outer conductor 16. In the end portion of the coaxial cable 13 with which the connector body 11 is connected, the outer insulator 17 is partially cut off so that the outer conductor 16 is exposed and each of the outer conductor 16 and the inner insulator 15 is partially cut off so that the core conductor 14 is exposed.

Figure 2:
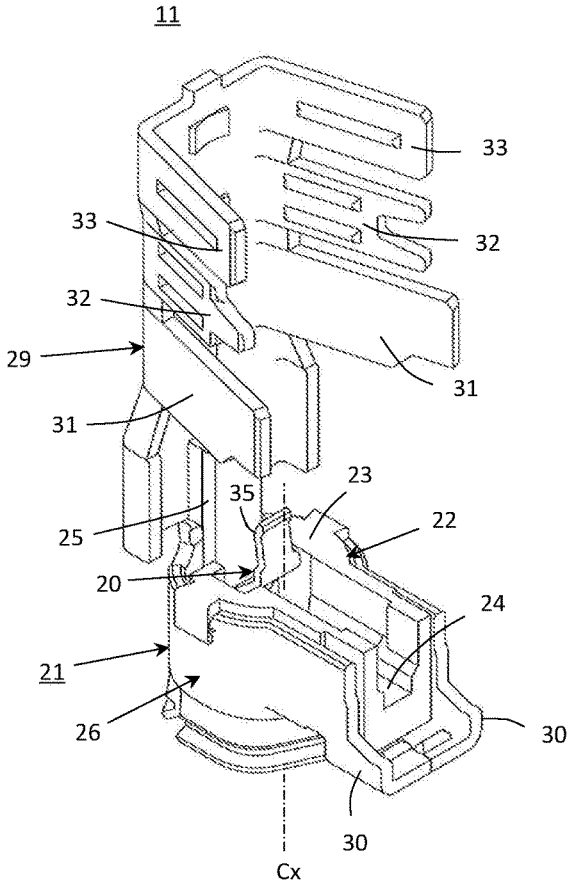
FIG. 2 is a schematic perspective view showing the connector body employed in the first embodiment of electrical coaxial connector according to the present invention.

As shown in FIG. 2, the connector body 11 includes a signal contact member 20 made of resilient conductive material to be connected with the core conductor 14 of the coaxial cable 13, a grounding contact member 21 which is made of resilient conductive material to be connected with the outer conductor 16 of the coaxial cable 13 and a housing member 22 made of insulator for supporting the signal contact member 20 and the grounding contact member 21 in such a manner that the signal contact member 20 and the grounding contact member 21 are isolated from each other.

The housing member 22 has a base portion 23 for holding the signal contact member 20. The base portion 23 of the housing member 22 is provided with a core conductor supporting portion 24 for supporting the core conductor 14 of the coaxial cable 13 which is to be connected with the signal contact member 20 and a bending press-contact portion 25 extending from an end of the base portion 23 to be bendable and operative to be bent for coming into press-contact with the signal contact member 20.

The grounding contact member 21 has an annular engaging portion 26 surrounding the base portion 23 of the housing member 22. The annular engaging portion 26 of the grounding contact member 21 is formed into a tubular body having an imaginary central axis shown with an imaginary central line Cx in FIG. 2 and provided thereon with a slit 27 extending in a direction along the imaginary central axis shown with the imaginary central line Cx, as shown in FIGS. 6, 10, 13 and 14 explained later. The annular engaging portion 26 having the slit 27 is able to be subjected by means of resilience thereof to both of an enlarging deformation for widening the slit 27 so as to enlarge temporarily an inside diameter of the annular engaging portion 26 and a reducing deformation for returning to the original state. Further, the annular engaging portion 26 of the grounding contact member 21 is provided on a curved inner surface thereof with an engagement-acting portion 28 which is formed to be a protrusion projecting from the curved inner surface toward the inside of the annular engaging portion 26, as shown in FIG. 1. The base portion 23 of the housing member 22 and the annular engaging portion 26 of the grounding contact member 21 surrounding the base portion 23 of the housing member 22 constitute a connectively coupling portion of the connector body 11 and, with such connectively coupling portion, the connector body 11 connected with the end portion of the coaxial cable 13 is coupled with the mating coaxial connector. On that occasion, the annular engaging portion 26 of the grounding contact member 21 is caused to engage with an annular grounding contact of the mating coaxial connector.

The grounding contact member 21 is further provided, in addition to the annular engaging portion 26, with a shell portion 29 extending to be bendable from the annular engaging portion 26 and operative to be bent for coming into connection with the outer conductor 16 of the coaxial cable 13 having the core conductor 14 connected with the signal contact member 20 and a pair of cable-guard portions 30 for protecting the coaxial cable 13 having the core conductor 14 connected with the signal contact member 20.

The shell portion 29 of the grounding contact member 21 takes up selectively an upright position wherein the shell portion 29 is not bent with regard to the annular engaging portion 26 and a folded position wherein the shell portion 29 is bent with regard to the annular engaging portion 26. In FIG. 1, the shell portion 29 is caused to take up the folded position and in FIG. 2, the shell portion 29 is caused to take up the upright position.

The shell portion 29 of the grounding contact member 21 is provided with a pair of first bendable engaging portions 31 which are operative to be bent for engaging with the cable-guard portions 30, a pair of second bendable engaging portions 32 which are operative to be bent for engaging with the outer conductor 16 of the coaxial cable 13 having the core conductor 14 connected with the signal contact member 20, and a pair of third bendable engaging portions 33 which are operative to be bent for engaging with the outer insulator 17 of the coaxial cable 13 having the core conductor 14 connected with the signal contact member 20.

Figure 6:
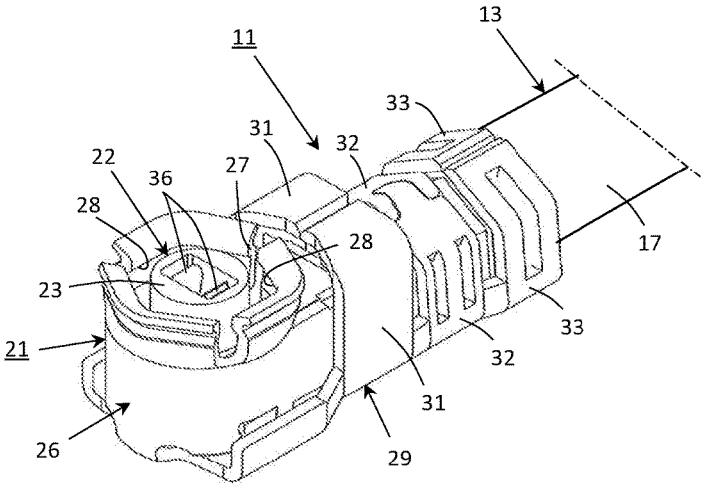
FIG. 6 is a schematic bottom side perspective view showing the connector body employed in the first embodiment of electrical coaxial connector according to the present invention mounted on the end portion of the coaxial cable.

The signal contact member 20 employed in the connector body 11 has a connecting terminal portion 35 formed to be bendable and operative to be bent for connecting with the core conductor 14 of the coaxial cable 13 and a pair of contacting terminal portions 36 as shown in FIG. 6 which extend for facing each other from a part of the signal contact member 20 on which the connecting terminal portion 35 is provided. Each of the contacting terminal portions 36 elongates along the imaginary central axis shown with the imaginary central line Cx of the annular engaging portion 26 of the grounding contact member 21 for penetrating the base portion 23 of the housing member 22.

Figure 3:
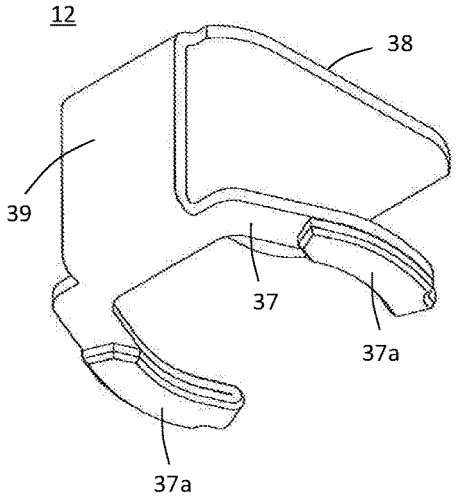
FIG. 3 is a schematic perspective view showing the locking component employed in the first embodiment of electrical coaxial connector according to the present invention.

The locking component 12 which constitutes the electrical coaxial connector 10 together with the connector body 11 is used for engaging detachably with an outer peripheral surface of the annular engaging portion 26 of the grounding contact member 21. As shown in FIG. 3, the locking component 12 is provided thereon with a displaceable engaging portion 37 which is able to move around the outer peripheral surface of the annular engaging portion 26 of the grounding contact member 21 when the locking component 12 is caused to engage detachably with the outer peripheral surface of the annular engaging portion 26 of the grounding contact member 21, a flat portion 38 which is positioned to be close to or in contact with the shell portion 29 of the grounding contact member 21 bent toward the annular engaging portion 26 of the grounding contact member 21 when the locking component 12 is engaged with the outer peripheral surface of the annular engaging portion 26 of the grounding contact member 21 under a condition wherein the shell portion 29 of the grounding contact member 21 has been bent toward the annular engaging portion 26 of the grounding contact member 21, and a connecting portion 39 for connecting the flat portion 38 with the displaceable engaging portion 37. The locking component 12 thus provided with the displaceable engaging portion 37, the flat portion 38 and the connecting portion 39 is, for example, formed integrally by a metallic plate subjected to bending processing.

The displaceable engaging portion 37 of the locking component 12 is formed to curve along the outer peripheral surface of the annular engaging portion 26 of the grounding contact member 21 so as to have a pair of engaging arms **37*a* facing each other. An engaging opening is formed between a pair of opposite top ends of the engaging arms 37*a* of the displaceable engaging portion 37 and the annular engaging portion 26 of the grounding contact member 21 passes through the engaging opening formed between the opposite top ends of the engaging arms 37*a* of the displaceable engaging portion 37 when the locking component 12 is caused to engage detachably with the outer peripheral surface of the annular engaging portion 26 of the grounding contact member 21**.

When the electrical coaxial connector 10 described above is mounted on the end portion of the coaxial cable 13, first, as shown in FIG. 4, the core conductor 14 of the coaxial cable 13 having the end portion thereof wherein the outer insulator 17 is partially cut off so that the outer conductor 16 is exposed and each of the outer conductor 16 and the inner insulator 15 is partially cut off so that the core conductor 14 is exposed, is put on the core conductor supporting portion 24 provided on the base portion 23 of the housing member 22 under a condition wherein the shell portion 29 of the grounding contact member 21 takes up the upright position and the bending press-contact portion 25 provided on the housing member 22 is not bent.

Then, the shell portion 29 of the grounding contact member 21 taking up the upright position is bent with regard to the annular engaging portion 26 of the grounding contact member 21 so as to take up the folded position. At that occasion, the bending press-contact portion 25 provided on the housing member 22 is bent along with the shell portion 29 so as to come into contact with the connecting terminal portion 35 of the signal contact member 20 and push the same to move against the core conductor 14 of the coaxial cable 13 put on the core conductor supporting portion 24 provided on the base portion 23 of the housing member 22 so that the connecting terminal portion 35 is caused to engage with the core conductor 14 of the coaxial cable 13. Thereby, the core conductor 14 of the coaxial cable 13 is mechanically and electrically connected with the connecting terminal portion 35 of the signal contact member 20.

After that, in the shell portion 29 of the grounding contact member 21 taking up the folded position, each of the first bendable engaging portions 31 is bent for engaging with the cable-guard portions 30 of the grounding contact member 21, each of the second bendable engaging portions 32 is bent for engaging with the outer conductor 16 of the coaxial cable 13 having the core conductor 14 connected with the connecting terminal portion 35 of the signal contact member 20, and each of the third bendable engaging portions 33 is bent for engaging with the outer insulator 17 of the coaxial cable 13 having the core conductor 14 connected with the connecting terminal portion 35 of the signal contact member 20. Thereby, the shell portion 29 of the grounding contact member 21 is mechanically and electrically connected with the outer conductor 16 of the coaxial cable 13. As a result, a condition wherein the connector body 11 constituting the electrical coaxial connector 10 is mechanically and electrically connected with the end portion of the coaxial cable 13 is surely and rigidly maintained.

Figure 5:
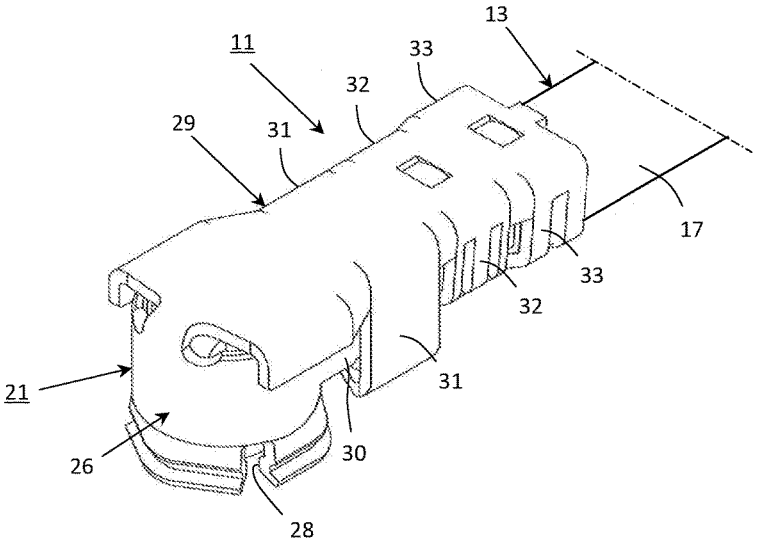
FIG. 5 is a schematic top side perspective view showing the connector body employed in the first embodiment of electrical coaxial connector according to the present invention mounted on the end portion of the coaxial cable.

FIGS. 5 and 6 show the connector body 11 constituting the electrical coaxial connector 10 which is mechanically and electrically connected with the end portion of the coaxial cable 13. In FIG. 6, the contacting terminal portions 36 of the signal contact member 20 are put in the base portion 23 of the housing member 22 surrounded by the annular engaging portion 26 of the grounding contact member 21. Further, in FIG. 6, the slit 27 provided on the annular engaging portion 26 of the grounding contact member 21 and the engagement-acting portion 28 provided on the curved inner surface of the annular engaging portion 26 of the grounding contact member 21 are clearly shown.

Figure 7:
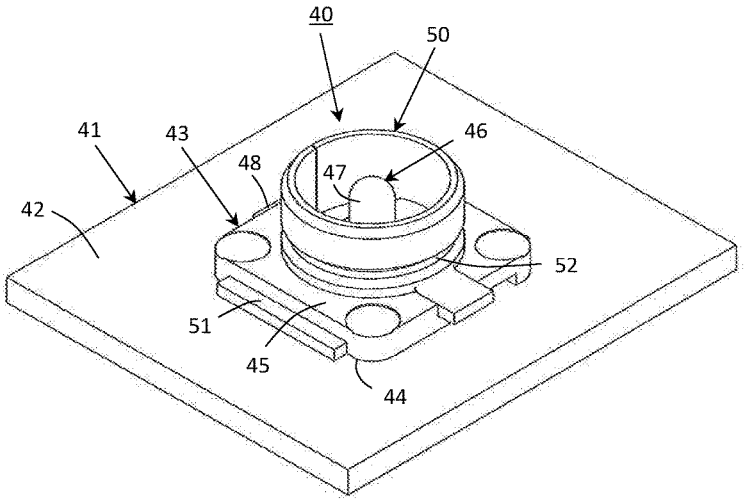
FIG. 7 is a schematic perspective view showing an example of a mating coaxial connector fixed to a circuit board, with which the first embodiment of electrical coaxial connector according to the present invention is to be mechanically and electrically coupled.

FIG. 7 shows a mating coaxial connector 40 which constitutes an example of mating coaxial connector with which the electrical coaxial connector 10 is coupled and a circuit board 41 having a parts-mountable surface 42 to which the mating coaxial connector 40 is fixed.

The mating coaxial connector 40 is provided with a base board 43 made of insulating material to be put on the parts-mountable surface 42 of the circuit board 41 so as to cause the mating coaxial connector 40 to be fixed to the parts-mountable surface 42 of the circuit board 41. The base board 43 of the mating coaxial connector 40 has a bottom plane portion 44 facing closely the parts-mountable surface 42 of the circuit board 41 and a top plane portion 45 opposite to the bottom plane portion 44. At a central portion of the base board 43, an opening (not shown in the drawings) is formed to pass through the bottom plane portion 44 and the top plane portion 45.

The mating coaxial connector 40 is also provided with a signal contact 46 made of conductive material to be fixed to the base board 43. The signal contact 46 has a central contacting portion 47 shaped into a column-like portion to extend from the bottom plane portion 44 through the opening formed at the central portion of the base board 43 to the top plane portion 45, and a signal connecting portion 48 provided on the bottom plane portion 44 to extend from the central contacting portion 47 to the outside of the base board 43. The central contacting portion 47 is operative to be put in contact with the contacting terminal portions 36 of the signal contact member 20 of the electrical coaxial connector 10 coupled with the mating coaxial connector 40 and the signal connecting portion 48 is operative to be connected, for example, by means of soldering, with a signal terminal provided on the parts-mountable surface 42 of the circuit board 41 on which the base board 43 is put.

The mating coaxial connector 40 is further provided with an annular grounding contact 50 made of conductive material to be fixed to the base board 43 so as to project outwardly from the top plane portion 45 of the base board 43 for surrounding the central contacting portion 47 of the signal contact 46. The annular grounding contact 50 is provided with a ground connecting portion 51 extending from the top plane portion 45 of the base board 43 to penetrate the base board 43 to the outside of the bottom plane portion 44 of the base board 43 and an engagement-receiving portion 52 formed into a groove on a curved outer surface of the annular grounding contact 50. The annular grounding contact 50 is operative to be engaged with the annular engaging portion 26 of the grounding contact member 21 employed in the connector body 11 constituting the electrical coaxial connector 10 coupled with the mating coaxial connector 40 in a condition wherein the engagement-acting portion 28 provided on the curved inner surface of the annular engaging portion 26 of the grounding contact member 21 comes into engagement with the engagement-receiving portion 52 provided on the curved outer surface of the annular grounding contact 50. The ground connecting portion 51 of the annular grounding contact 50 is connected, for example, by means of soldering, with a ground terminal provided on the parts-mountable surface 42 of the circuit board 41 on which the base board 43 is put. The annular grounding contact 50 can be integrally fixed to the base board 43, for example, by means of insert molding.

Although the engagement-acting portion 28 provided on the curved inner surface of the annular engaging portion 26 of the grounding contact member 21 employed in the connector body 11 is formed to be the protrusion and the engagement-receiving portion 52 provided on the curved outer surface of the annular grounding contact 50 employed in the mating coaxial connector 40 is formed to be the groove with which the protrusion constituting the engagement-receiving portion 52 engages in the above-mentioned combination of the connector body 11 and the mating coaxial connector, it is also possible that the engagement-acting portion 28 provided on the curved inner surface of the annular engaging portion 26 of the grounding contact member 21 employed in the connector body 11 is formed to be a groove and the engagement-receiving portion 52 provided on the curved outer surface of the annular grounding contact 50 employed in the mating coaxial connector 40 is formed to be a protrusion for engaging with the groove constituting the engagement-acting portion 28.

Figure 8:
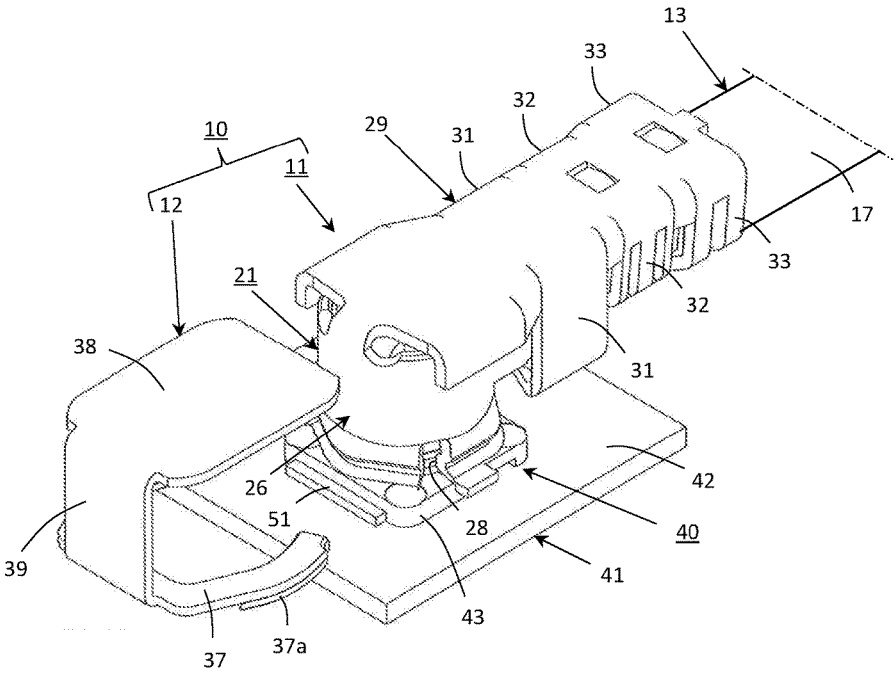
FIG. 8 is a schematic perspective view showing the first embodiment of electrical coaxial connector according to the present invention mounted on the end portion of the coaxial cable and coupled mechanically and electrically with the example of the mating coaxial connector fixed to the circuit board, herein the locking component is removed from the connector body.

FIG. 8 shows the connector body 11 connected with the end portion of the coaxial cable 13 and coupled mechanically and electrically with the mating coaxial connector 40 shown in FIG. 7 and the locking component 12 provided to be caused to engage detachably with the outer peripheral surface of the annular engaging portion 26 of the grounding contact member 21 employed in the connector body 11. When the connector body 11 is mechanically and electrically coupled with the mating coaxial connector 40 as shown in FIG. 8, the annular engaging portion 26 of the grounding contact member 21 employed in the connector body 11 is caused to engage with the annular grounding contact 50 employed in the mating coaxial connector 40 and the engagement-acting portion 28 provided on the curved inner surface of the annular engaging portion 26 of the grounding contact member 21 comes into engagement with the engagement-receiving portion 52 provided on the curved outer surface of the annular grounding contact 50, so that the engagement of the annular engaging portion 26 of the grounding contact member 21 with the annular grounding contact 50 employed in the mating coaxial connector 40 is stably maintained.

Figure 9:
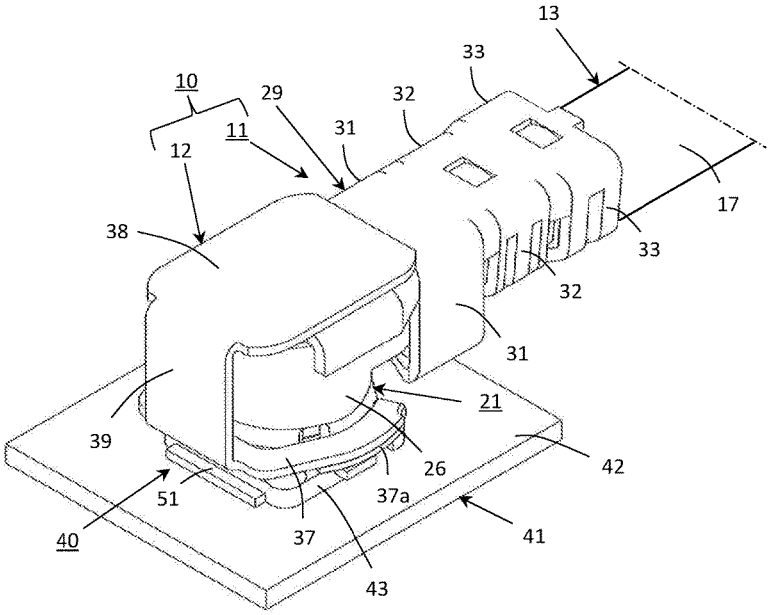
FIG. 9 is a schematic perspective view showing the first embodiment of electrical coaxial connector according to the present invention mounted on the end portion of the coaxial cable and coupled mechanically and electrically with the example of the mating coaxial connector fixed to the circuit board, wherein the locking component is caused to engage with the connector body.
Figure 10:
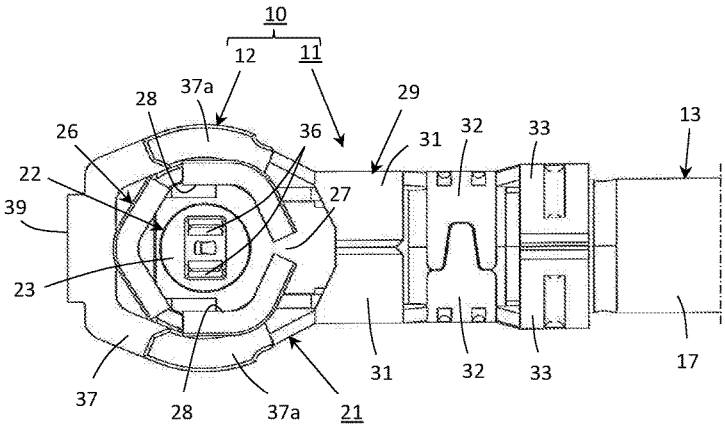
FIG. 10 is a schematic bottom view showing the first embodiment of electrical coaxial connector according to the present invention mounted on the end portion of the coaxial cable, wherein the locking component is caused to engage with the connector body.

Under such a condition that the annular engaging portion 26 of the grounding contact member 21 employed in the connector body 11 is caused to engage with the annular grounding contact 50 employed in the mating coaxial connector 40 as described above, the locking component 12 is caused to engage detachably with the outer peripheral surface of the annular engaging portion 26 of the grounding contact member 21 employed in the connector body 11, as shown in FIGS. 9 and 10. On that occasion, the annular engaging portion 26 of the grounding contact member 21 passes through the engaging opening formed between the opposite top ends of the engaging arms 37*a* of the displaceable engaging portion 37 provided on the locking component 12 so that the locking component 12 engages with the annular engaging portion 26 of the grounding contact member 21. Then, the displaceable engaging portion 37 provided on the locking component 12 is positioned to be able to move around the outer peripheral surface of the annular engaging portion 26 of the grounding contact member 21 and the flat portion 38 provided on the locking component 12 is positioned to be close to or in contact with the shell portion 29 of the grounding contact member 21. At this time, the locking component 12 is put in a non-locking state.

Figure 11:
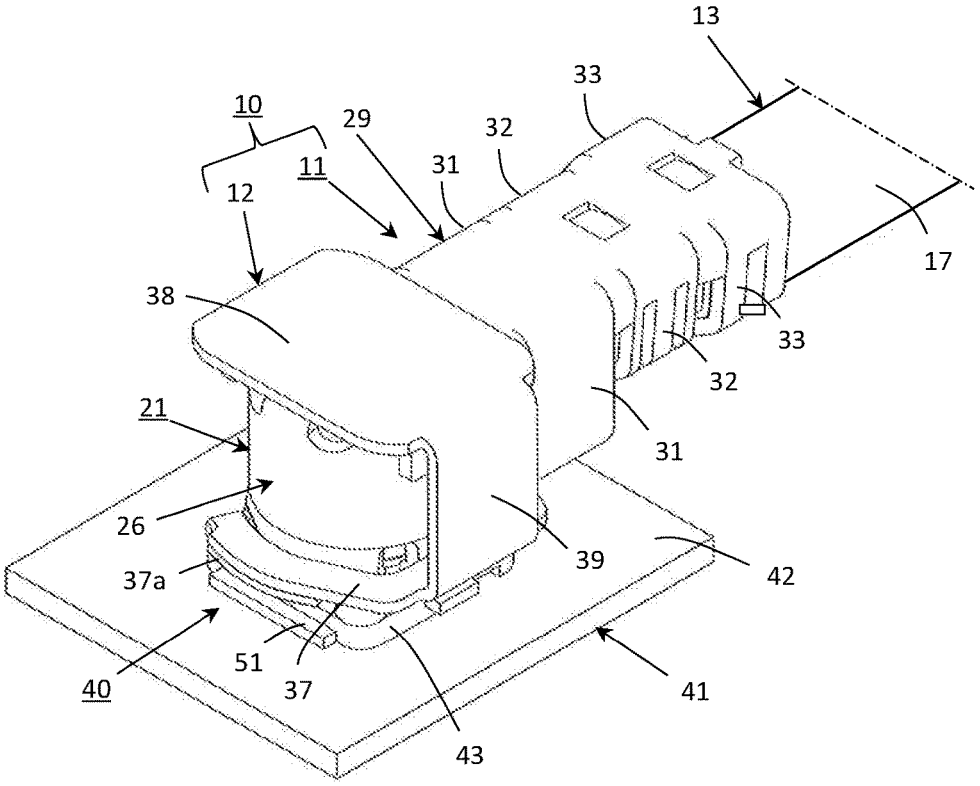
FIG. 11 is a schematic perspective view showing the first embodiment of electrical coaxial connector according to the present invention mounted on the end portion of the coaxial cable and coupled mechanically and electrically with the example of the mating coaxial connector fixed to the circuit board, wherein the locking component is caused to engage with the connector body and then rotated with regard to the connector body.
Figure 12:
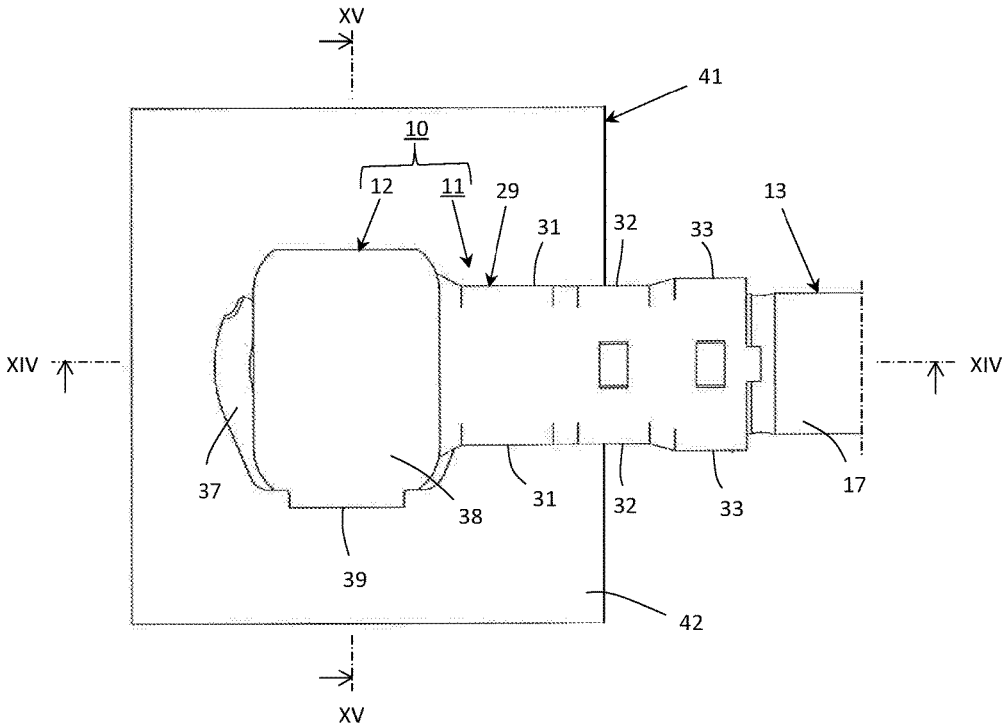
FIG. 12 is a schematic plan view showing the first embodiment of electrical coaxial connector according to the present invention mounted on the end portion of the coaxial cable and coupled mechanically and electrically with the example of the mating coaxial connector fixed to the circuit board, wherein the locking component is caused to engage with the connector body and then rotated with regard to the connector body.
Figure 13:
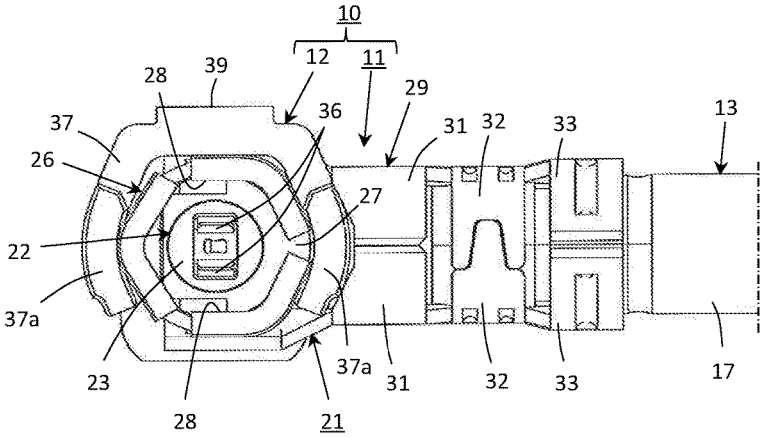
FIG. 13 is a schematic bottom view showing the first embodiment of electrical coaxial connector according to the present invention mounted on the end portion of the coaxial cable, wherein the locking component is caused to engage with the connector body and then rotated with regard to the connector body.
Figure 14:
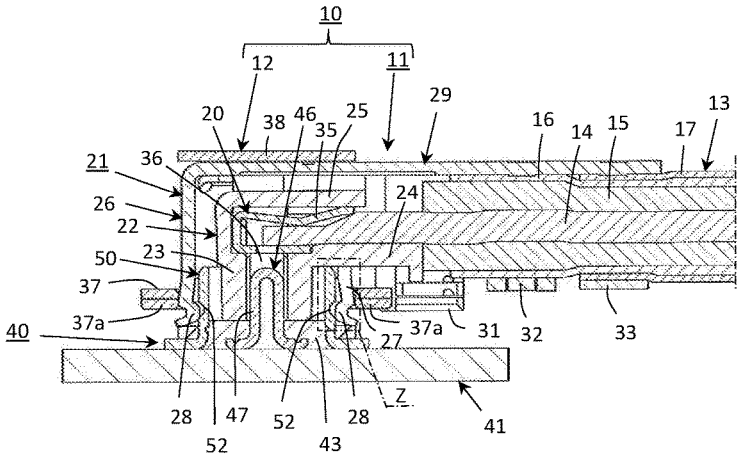
FIG. 14 is a schematic cross-sectional view taken along line XIV-XIV in FIG. 12.

After that, the locking component 12 put in the non-locking state is caused to rotate with regard to the annular engaging portion 26 of the grounding contact member 21 with the displaceable engaging portion 37 provided thereon moving around the outer peripheral surface of the annular engaging portion 26 so as to be put in a locking state, as shown in FIGS. 11, 12 and 13. When the locking component 12 is thus put in the locking state, the displaceable engaging portion 37 provided on the locking component 12 is operative to lock the annular engaging portion 26 of the grounding contact member 21 from the outside of the same at the position wherein the slit 27 provided on the annular engaging portion 26 is partially closed by one of the engaging arms 37*a* of the displaceable engaging portion 37, so that the annular engaging portion 26 is prevented from being subjected to expanding deformation to widen the slit 27, as shown in FIG. 13.

Figure 15:
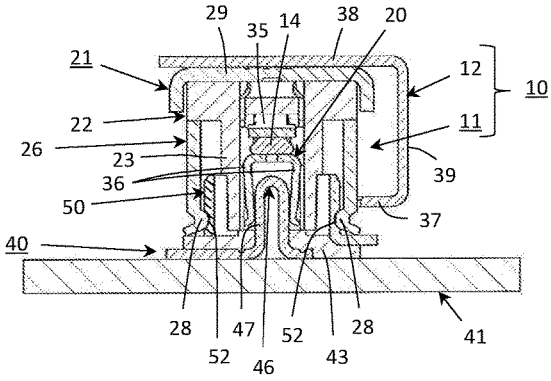
FIG. 15 is a schematic cross-sectional view taken along line XV-XV in FIG. 12.

Under a condition wherein the annular engaging portion 26 of the grounding contact member 21 employed in the connector body 11 which is connected with the end portion of the coaxial cable 13 is caused to engage with the annular grounding contact 50 employed in the mating coaxial connector 40 and the locking component 12 is caused to engage with the outer peripheral surface of the annular engaging portion 26 so as to be put in the locking state as described above, as shown in FIGS. 14 and 15, the contacting terminal portions 36 of the signal contact member 20 which is supported by the housing member 22 of the connector body 11 to have the connecting terminal portion 35 connected with the core conductor 14 of the coaxial cable 13 are caused to come into contact with the central contacting portion 47 shaped into the column-like portion of the signal contact 46 employed in the mating coaxial connector 40. As a result, the core conductor 14 of the coaxial cable 13 is connected through the signal contact member 20 employed in the connector body 11 and the signal contact 46 employed in the mating coaxial connector 40 with the signal terminal provided on the parts-mountable surface 42 of the circuit board 41, and the outer conductor 16 of the coaxial cable 13 is connected through the grounding contact member 21 employed in the connector body 11 and the annular grounding contact 50 employed in the mating coaxial connector 40 with the grounding terminal provided on the parts-mountable surface 42 of the circuit board 41.

Further, the locking component 12, which is caused to engage with the outer peripheral surface of the annular engaging portion 26 of the grounding contact member 21 employed in the connector body 11 so as to be put in the locking state, is operative to cause the displaceable engaging portion 37 provided thereon to lock the annular engaging portion 26 of the grounding contact member 21 from the outside of the same at the position wherein the slit 27 provided on the annular engaging portion 26 is partially closed by one of the engaging arms 37*a* of the displaceable engaging portion 37, so that the annular engaging portion 26 is prevented from being subjected to expanding deformation to widen the slit 27.

Thereby, for example, when an undesirable external force acts on the annular engaging portion 26 of the grounding contact member 21 put in engagement with the annular grounding contact 50 employed in the mating coaxial connector 40 for causing the annular engaging portion 26 to be subjected to expanding deformation to widen the slit 27 provided thereon so that the engagement-acting portion 28 provided on the curved inner surface of the annular engaging portion 26 is disengaged from the engagement-receiving portion 52 provided on the curved outer surface of the annular grounding contact 50, the annular engaging portion 26 is prevented by the displaceable engaging portion 37 provided on the locking component 12 put in the locking state from being subjected to the expanding deformation to widen the slit 27, and as a result, the engagement of the engagement-acting portion 28 with the engagement-receiving portion 52 is maintained so that the engagement of the annular engaging portion 26 with the annular grounding contact 50 is continuously and stably kept. This results in that the mechanical and electrical coupling of the electrical coaxial connector 10 with the mating coaxial connector 40 is surely and stably maintained without being undesirably released.

Figure 16:
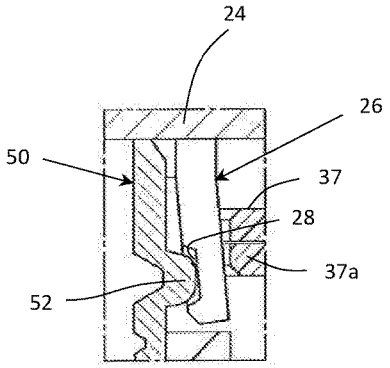
FIG. 16 is a schematic cross-sectional view showing a part of a modification of each of the first embodiment of electrical coaxial connector according to the present invention and the example of the mating coaxial connector.

FIG. 16 shows a part of a modification of the electrical coaxial connector 10 in which the engagement-acting portion 28 provided on the curved inner surface of the annular engaging portion 26 of the grounding contact member 21 employed in the connector body 11 is formed to be a groove and a part of a modification of the mating coaxial connector 40 in which the engagement-receiving portion 52 provided on the curved outer surface of the annular ground contact employed in the mating coaxial connector 40 is formed to be a protrusion. In FIG. 16, the engagement-acting portion 28 formed to be the groove is caused to engage with the engagement-receiving portion 52 formed to be the protrusion in a portion corresponding to the portion in a dot-dash line frame Z in FIG. 14 under the condition wherein the annular engaging portion 26 of the grounding contact member 21 employed in the connector body 11 is caused to engage with the annular grounding contact 50 employed in the mating coaxial connector 40 and the locking component 12 is caused to engage with the outer peripheral surface of the annular engaging portion 26 so as to be put in the locking state.

When the annular engaging portion 26 of the grounding contact member 21 employed in the connector body 11 is caused intentionally to release the engagement with the annular grounding contact 50 employed in of the mating coaxial connector 40 under the condition wherein the annular engaging portion 26 of the grounding contact member 21 is caused to engage with the annular grounding contact 50 employed in the mating coaxial connector 40 and the locking component 12 is caused to engage with the outer peripheral surface of the annular engaging portion 26 so as to be put in the locking state, first, the locking component 12 is rotated with regard to the annular engaging portion 26 to shift from the locking state to the non-locking state and detached from the outer peripheral surface of the annular engaging portion 26. Then, an appropriate external force is applied to the annular engaging portion 26 of the grounding contact member 21 for disengaging from the annular grounding contact 50 employed in the mating coaxial connector 40. With the appropriate external force thus applied, the annular engaging portion 26 is temporarily caused to deform for widening the slit 27 provided thereon so that the engagement-acting portion 28 provided on the curved inner surface of the annular engaging portion 26 is caused to release the engagement with the engagement-receiving portion 52 provided on the curved outer surface of the annular grounding contact 50 employed in the mating coaxial connector 40 and thereby the annular engaging portion 26 is able to release the engagement with the annular grounding contact 50 employed in the mating coaxial connector 40.

With the electrical coaxial connector 10 constituting the first embodiment of the electrical coaxial connector according to the present invention, on the occasion of the mechanical and electrical coupling with the mating coaxial connector 40 fixed to the circuit board 41, the annular engaging portion 26 of the grounding contact member 21 employed in the connector body 11 is caused to engage with the annular grounding contact 50 employed in the mating coaxial connector 40 and the locking component 12 made to be separate from the connector body 11 and provided thereon with the displaceable engaging portion 37 is caused to engage with the outer peripheral surface of the annular engaging portion 26 so as to be put in the locking state. Under such a situation, the displaceable engaging portion 37 of the locking component 12 put in the locking state is operative to lock the annular engaging portion 26 of the grounding contact member 21 from the outside of the same so that the annular engaging portion 26 is prevented from being subjected to expanding deformation to widen the slit 27 provided thereon so that the annular engaging portion 26 is operative to keep continuously the engagement with the annular grounding contact 50 employed in the mating coaxial connector 40 even when an undesirable external force acts on the annular engaging portion 26 put in engagement with the annular grounding contact 50 employed in the mating coaxial connector 40 for causing the annular engaging portion 26 to remove from the annular grounding contact 50 employed in the mating coaxial connector 40. As a result, the mechanical and electrical coupling of the electrical coaxial connector 10 with the mating coaxial connector 40 can be surely and stably maintained without being undesirably released.

The locking component 12 provided thereon with the displaceable engaging portion 37 is, for example, formed integrally by the metallic plate subjected to bending processing so as to be caused to engage with the outer peripheral surface of the annular engaging portion 26 and put selectively in the locking state and the non-locking state, and this results in a relatively simple structure of the electrical coaxial connector 10.

Further, on the occasion of causing the locking component 12 to engage detachably with the outer peripheral surface of the annular engaging portion 26 of the grounding contact member 21 employed in the connector body 11 so as to be put in the locking state, a relatively simple operation for causing the locking component 12 to be attached to the annular engaging portion 26 with use of the engaging opening formed between the opposite top ends of the engaging arms 37*a* of the displaceable engaging portion 37 provided on the locking component 12 and to rotate with regard to the annular engaging portion 26 is only required without requiring a considerably large operation force.

Accordingly, when the electrical coaxial connector 10 is mechanically and electrically coupled with the mating coaxial connector 40 fixed to the circuit board 41 to be put in practical use, the mechanical and electrical coupling of the electrical coaxial connector 10 with the mating coaxial connector 40 can be surely maintained for preventing the electrical coaxial connector 10 from removing undesirably from the mating coaxial connector 40 with the relatively simple structure without any considerably large operation force.

Figure 17:
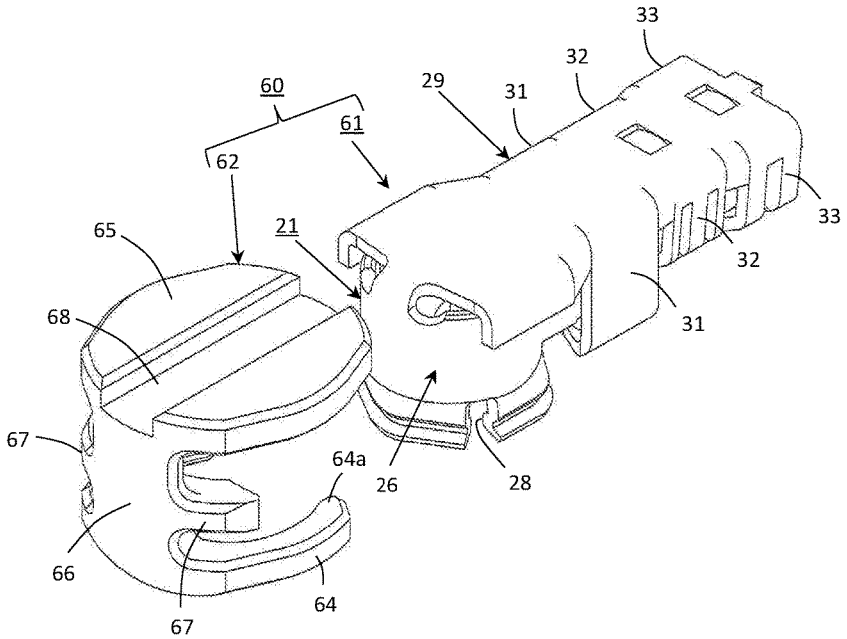
FIG. 17 is a schematic perspective view showing a second embodiment of electrical coaxial connector according to the present invention which comprises a connector body and a locking component.

FIG. 17 shows a second embodiment of electrical coaxial connector according to the present invention which is used to be mounted on an end portion of a coaxial cable and coupled with a mating coaxial connector.

Referring to FIG. 17, an electrical coaxial connector 60, which constitutes the second embodiment of electrical coaxial connector according to the present invention, includes a connector body 61 and a locking component 62. The connector body 61 is provided for being connected with the end portion of the coaxial cable and being coupled mechanically and electrically with the mating coaxial connector, and constituted in the same manner as the connector body 11 included in the electrical coaxial connector 10 constituting the first embodiment of electrical coaxial connector according to the present invention. Therefore, the connector body 61 has various parts and portions corresponding to those in the connector body 11 shown in FIGS. 1, 2, 4 to 6, which are marked with the same references as those in the connector body 11 in FIGS. 17 and 19 to 22, and further description thereof will be omitted.

A coaxial cable 63 (shown in FIGS. 19 to 22 explained latter) having an end portion thereof with which the connector body 61 is connected, is constituted in the same manner as the coaxial cable 13 having the end portion thereof with which the connector body 11 is connected. Therefore, the coaxial cable 63 has various parts and portions corresponding to those in the coaxial cable 13 shown in FIG. 4, which are marked with the same references as those in the coaxial cable 13 in FIGS. 19 to 22, and further description thereof will be omitted.

Further, a mating coaxial connector 70 (shown in FIGS. 19 to 22) with which the connector body 61 is mechanically and electrically coupled, is constituted in the same manner as the mating coaxial connector 40 shown in FIG. 7 with which the connector body 11 is mechanically and electrically coupled. Therefore, the mating coaxial connector 70 has various parts and portions corresponding to those in the mating coaxial connector 40, which are marked with the same references as those in the mating coaxial connector 70 in FIGS. 19 to 22, and further description thereof will be omitted.

Figure 18:
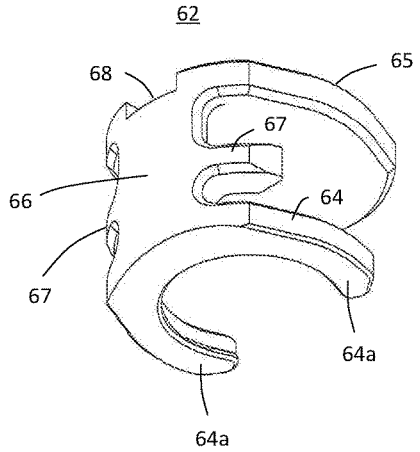
FIG. 18 is a schematic perspective view showing the locking component employed in the second embodiment of electrical coaxial connector according to the present invention.

The locking component 62 which constitutes the electrical coaxial connector 60 together with the connector body 61 is used for engaging detachably with an outer peripheral surface of an annular engaging portion 26 of a grounding contact member 21 employed in the connector body 61. As shown in FIG. 18, the locking component 62 is provided thereon with a displaceable engaging portion 64 which is able to move around the outer peripheral surface of the annular engaging portion 26 of the grounding contact member 21 employed in the connector body 61 when the locking component 62 is caused to engage detachably with the outer peripheral surface of the annular engaging portion 26 of the grounding contact member 21, a flat portion 65 which is positioned to be close to or in contact with a shell portion 29 of the grounding contact member 21 bent toward the annular engaging portion 26 of the grounding contact member 21 when the locking component 62 is engaged with the outer peripheral surface of the annular engaging portion 26 of the grounding contact member 21 under a condition wherein the shell portion 29 of the grounding contact member 21 has been bent toward the annular engaging portion 26 of the grounding contact member 21, and a connecting portion 66 for connecting the flat portion 65 with the displaceable engaging portion 64.

The connecting portion 66 of the locking component 62 is provided thereon with a pair of stopper portions 67 each projecting from the connecting portion 66 toward the outside of the same, so that the locking component 62 has the stopper portions 67 each projecting from the connecting portion 66. Each of the stopper portions 67 is operative to come into contact with a portion of the grounding contact member 21 employed in the connector body 61 so as to prevent the displaceable engaging portion 64 from moving excessively when the displaceable engaging portion 64 is caused to move around the outer peripheral surface of the annular engaging portion 26 of the grounding contact member 21 employed in the connector body 61.

The flat portion 65 of the locking component 62 is provided with a groove 68 formed on an outer surface portion thereof. When a predetermined driving tool is caused to engage with the groove 68 and rotated in association with the same, the locking component 62 which is provided with the displaceable engaging portion 64 operative to move around the outer peripheral surface of the annular engaging portion 26 of the grounding contact member 21 employed in the connector body 61, the flat portion 65 provided with the groove 68 and the connecting portion 66 provided with the stopper portions 67, is rotated on the whole.

The locking component 62 thus provided with the displaceable engaging portion 64, the flat portion 65 and the connecting portion 66 with the stopper portions 67 is, for example, formed integrally by metallic material subjected to cutting processing.

The displaceable engaging portion 64 of the locking component 62 is formed to curve along the outer peripheral surface of the annular engaging portion 26 of the grounding contact member 21 employed in the connector body 61 so as to have a pair of engaging arms 64*a* facing each other. An engaging opening is formed between a pair of opposite top ends of the engaging arms 64*a* of the displaceable engaging portion 64 and the annular engaging portion 26 of the grounding contact member 21 passes through the engaging opening formed between the opposite top ends of the engaging arms 64*a* of the displaceable engaging portion 64 when the locking component 62 is caused to engage detachably with the outer peripheral surface of the annular engaging portion 26 of the grounding contact member 21.

The connector body 61 constituting the electrical coaxial connector 60 is mechanically and electrically connected with the end portion of the coaxial cable 63 in the same manner that the connector body 11 constituting the electrical coaxial connector 10 is mechanically and electrically connected with the end portion of the coaxial cable 13.

Figure 19:
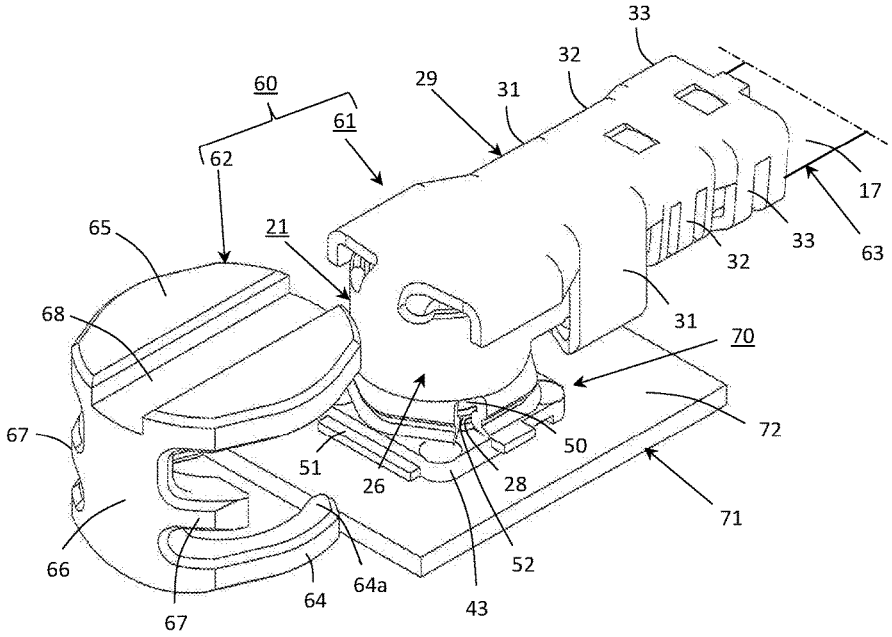
FIG. 19 is a schematic perspective view showing the second embodiment of electrical coaxial connector according to the present invention mounted on the end portion of the coaxial cable and coupled mechanically and electrically with an example of a mating coaxial connector fixed to a circuit board, herein the locking component is removed from the connector body.

FIG. 19 shows the connector body 61 connected with the end portion of the coaxial cable 63 and coupled mechanically and electrically with the mating coaxial connector 70 fixed to a parts-mountable surface 72 of a circuit board 71 and the locking component 62 provided to be caused to engage detachably with the outer peripheral surface of the annular engaging portion 26 of the grounding contact member 21 employed in the connector body 61. When the connector body 61 is mechanically and electrically coupled with the mating coaxial connector 70 as shown in FIG. 19, the annular engaging portion 26 of the grounding contact member 21 employed in the connector body 61 is caused to engage with an annular grounding contact 50 employed in the mating coaxial connector 70 and an engagement-acting portion 28 provided on a curved inner surface of the annular engaging portion 26 of the grounding contact member 21 comes into engagement with an engagement-receiving portion 52 provided on a curved outer surface of the annular grounding contact 50, so that the engagement of the annular engaging portion 26 of the grounding contact member 21 with the annular grounding contact 50 employed in the mating coaxial connector 70 is stably maintained.

Figure 20:
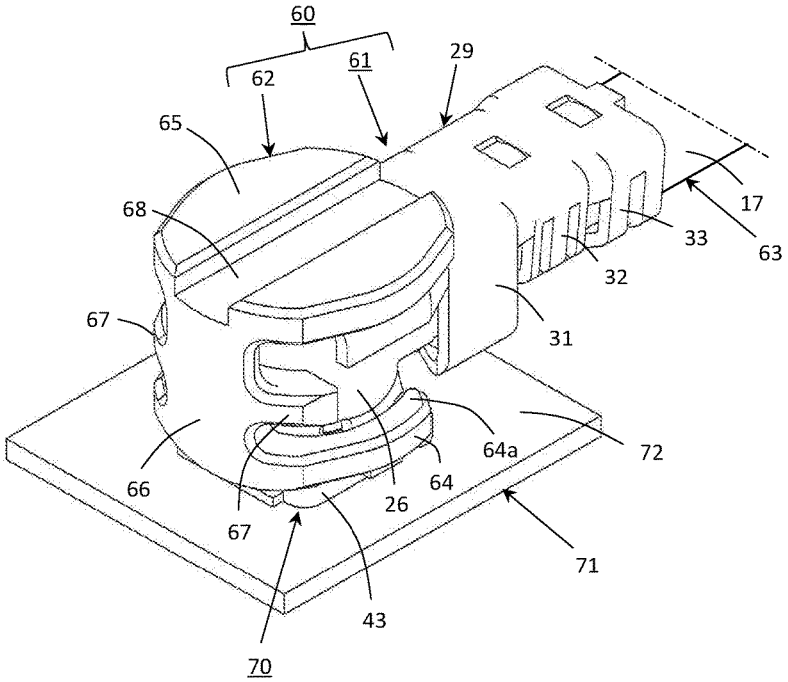
FIG. 20 is a schematic perspective view showing the second embodiment of electrical coaxial connector according to the present invention mounted on the end portion of the coaxial cable and coupled mechanically and electrically with the example of the mating coaxial connector fixed to the circuit board, wherein the locking component is caused to engage with the connector body.

Under such a condition that the annular engaging portion 26 of the grounding contact member 21 employed in the connector body 61 is caused to engage with the annular grounding contact 50 employed in the mating coaxial connector 70 as described above, the locking component 62 is caused to engage detachably with the outer peripheral surface of the annular engaging portion 26 of the grounding contact member 21 employed in the connector body 61, as shown in FIG. 20. On that occasion, the annular engaging portion 26 of the grounding contact member 21 passes through the engaging opening formed between the opposite top ends of the engaging arms 64*a* of the displaceable engaging portion 64 provided on the locking component 62 so that the locking component 62 engages with the annular engaging portion 26 of the grounding contact member 21. Then, the displaceable engaging portion 64 provided on the locking component 62 is positioned to be able to move around the outer peripheral surface of the annular engaging portion 26 of the grounding contact member 21 and the flat portion 65 provided on the locking component 62 is positioned to be close to or in contact with the shell portion 29 of the grounding contact member 21. At this time, the locking component 62 is put in a non-locking state.

Figure 21:
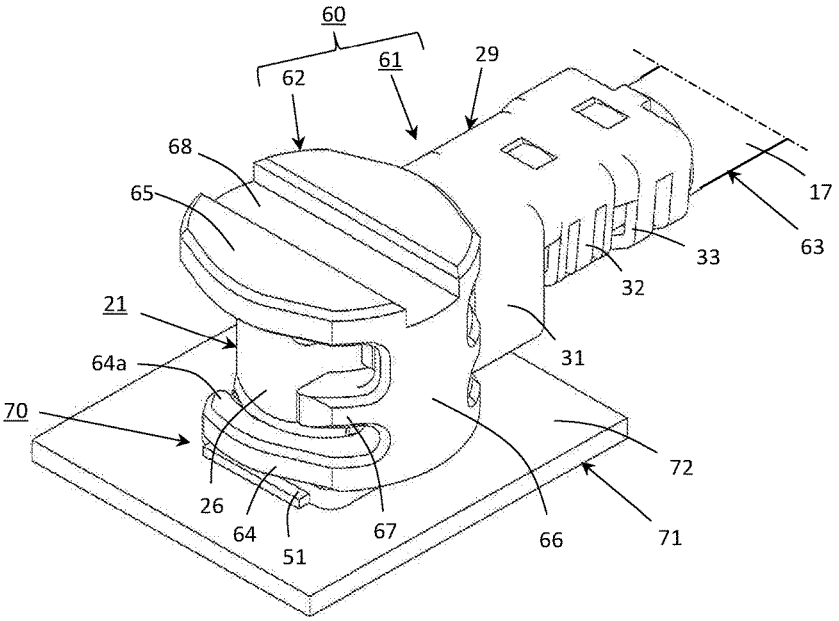
FIG. 21 is a schematic perspective view showing the second embodiment of electrical coaxial connector according to the present invention mounted on the end portion of the coaxial cable and coupled mechanically and electrically with the example of the mating coaxial connector fixed to the circuit board, wherein the locking component is caused to engage with the connector body and then rotated with regard to the connector body.
Figure 22:
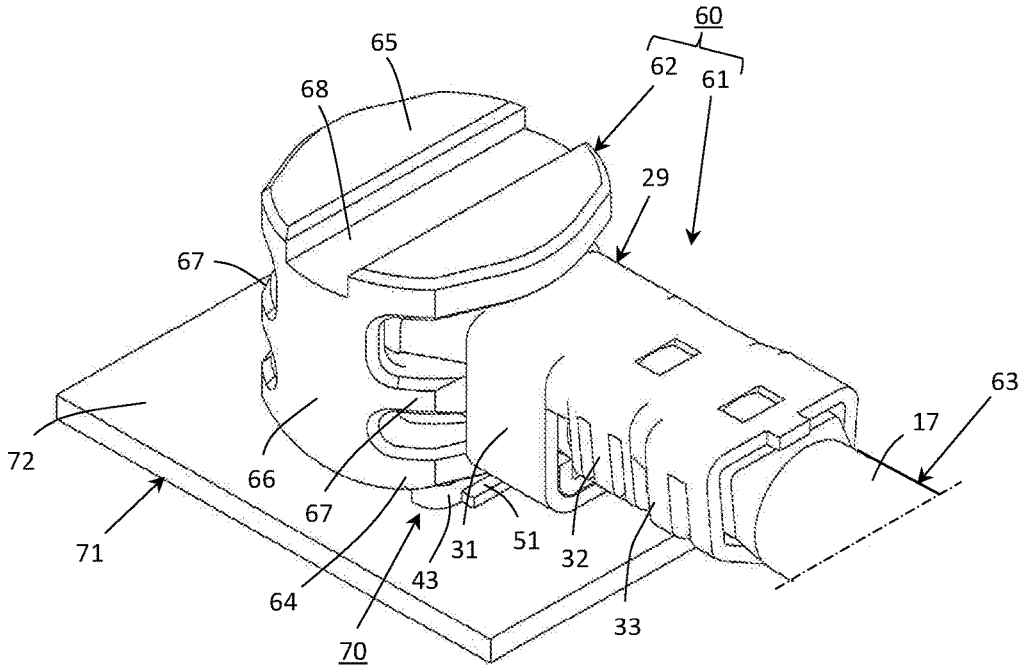
FIG. 22 is another schematic perspective view showing the second embodiment of electrical coaxial connector according to the present invention mounted on the end portion of the coaxial cable and coupled mechanically and electrically with the example of the mating coaxial connector fixed to the circuit board, wherein the locking component is caused to engage with the connector body and then rotated with regard to the connector body.

After that, the locking component 62 put in the non-locking state is caused to rotate, for example, by means of the predetermined driving tool caused to engage with the groove 68 and rotated in association with the same, with regard to the annular engaging portion 26 of the grounding contact member 21 with the displaceable engaging portion 64 provided thereon for moving around the outer peripheral surface of the annular engaging portion 26 so as to be put in a locking state, as shown in FIGS. 21 and 22. In a condition wherein the locking component 62 is thus put in the locking state, the displaceable engaging portion 64 provided on the locking component 62 is operative to lock the annular engaging portion 26 of the grounding contact member 21 from the outside of the same at the position wherein a slit provided on the annular engaging portion 26 is partially closed by one of the engaging arms 64*a* of the displaceable engaging portion 64, so that the annular engaging portion 26 is prevented from being subjected to expanding deformation to widen the slit.

When the locking component 62 is caused to rotate with regard to the annular engaging portion 26 of the grounding contact member 21 with the displaceable engaging portion 64 provided thereon for moving around the outer peripheral surface of the annular engaging portion 26, one of the stopper portions 67 provided on the connecting portion 66 of the locking component 62 is operative to come into contact with, for example, a first bendable engaging portions 31 provided on the shell portion 29 of the grounding contact member 21 employed in the connector body 61 as the portion of the grounding contact member 21 so as to prevent the displaceable engaging portion 64 from moving excessively, as shown in FIG. 22.

Under a condition wherein the annular engaging portion 26 of the grounding contact member 21 employed in the connector body 61 which is connected with the end portion of the coaxial cable 63 is caused to engage with the annular grounding contact 50 employed in the mating coaxial connector 70 and the locking component 62 is caused to engage with the outer peripheral surface of the annular engaging portion 26 so as to be put in the locking state as described above, a pair of contacting terminal portions of a signal contact member which is supported by a housing member of the connector body 61 to have a connecting terminal portion connected with a core conductor of the coaxial cable 63 are caused to come into contact with a central contacting portion shaped into a column-like portion of a signal contact employed in the mating coaxial connector 70. As a result, the core conductor of the coaxial cable 63 is connected through the signal contact member employed in the connector body 61 and the signal contact employed in the mating coaxial connector 70 with a signal terminal provided on the parts-mountable surface 72 of the circuit board 71, and an outer conductor of the coaxial cable 63 is connected through the grounding contact member 21 employed in the connector body 61 and the annular grounding contact 50 employed in the mating coaxial connector 70 with a grounding terminal provided on the parts-mountable surface 72 of the circuit board 71.

Further, in the same manner as the case of the electrical coaxial connector 10, the engagement of the annular engaging portion 26 of the grounding contact member 21 employed in the connector body 61 with the annular grounding contact 50 employed in the mating coaxial connector 70 is continuously and stably kept, and therefore the mechanical and electrical coupling of the electrical coaxial connector 60 with the mating coaxial connector 70 is surely and stably maintained without being undesirably released.

With the electrical coaxial connector 60 constituting the second embodiment of electrical coaxial connector according to the present invention, on the occasion of the mechanical and electrical coupling with the mating coaxial connector 70 fixed to the circuit board 71, the annular engaging portion 26 of the grounding contact member 21 employed in the connector body 61 is caused to engage with the annular grounding contact 50 employed in the mating coaxial connector 70 and the locking component 62 made to be separate from the connector body 61 and provided thereon with the displaceable engaging portion 64 is caused to engage with the outer peripheral surface of the annular engaging portion 26 so as to be put in the locking state. Under such a situation, the displaceable engaging portion 64 of the locking component 62 put in the locking state is operative to lock the annular engaging portion 26 of the grounding contact member 21 from the outside of the same so that the annular engaging portion 26 is prevented from being subjected to expanding deformation to widen the slit provided thereon so that the annular engaging portion 26 is operative to keep continuously the engagement with the annular grounding contact 50 employed in the mating coaxial connector 70 even when an undesirable external force acts on the annular engaging portion 26 put in engagement with the annular grounding contact 50 employed in the mating coaxial connector 70 for causing the annular engaging portion 26 to remove from the annular grounding contact 50 employed in the mating coaxial connector 70. As a result, the mechanical and electrical coupling of the electrical coaxial connector 60 with the mating coaxial connector 70 can be surely and stably maintained without being undesirably released.

In addition, since the connecting portion 66 of the locking component 62 is provided with the stopper portions 67 each projecting from the connecting portion 66, when the locking component 62 is caused to rotate with regard to the annular engaging portion 26 of the grounding contact member 21 with the displaceable engaging portion 64 provided thereon for moving around the outer peripheral surface of the annular engaging portion 26, one of the stopper portions 67 is operative to come into contact with the portion of the grounding contact member 21 so as to prevent the displaceable engaging portion 64 from moving excessively.

Further, the locking component 62, which is caused to engage with the outer peripheral surface of the annular engaging portion 26 of the grounding contact member 21 employed in the connector body 61 so as to be put in the locking state, is operative to cause the displaceable engaging portion 64 provided thereon to lock the annular engaging portion 26 of the grounding contact member 21 from the outside of the same at the position wherein the slit provided on the annular engaging portion 26 is partially closed by one of the engaging arms 64*a* of the displaceable engaging portion 64, so that the annular engaging portion 26 is prevented from being subjected to expanding deformation to widen the slit.

Thereby, for example, when an undesirable external force acts on the annular engaging portion 26 of the grounding contact member 21 put in engagement with the annular grounding contact 50 employed in the mating coaxial connector 70 for causing the annular engaging portion 26 to be subjected to expanding deformation to widen the slit provided thereon so that the engagement-acting portion provided on the curved inner surface of the annular engaging portion 26 is disengaged from the engagement-receiving portion provided on the curved outer surface of the annular grounding contact 50, the annular engaging portion 26 is prevented by the displaceable engaging portion 64 provided on the locking component 62 put in the locking state from being subjected to the expanding deformation to widen the slit, and as a result, the engagement of the engagement-acting portion with the engagement-receiving portion is maintained so that the engagement of the annular engaging portion 26 with the annular grounding contact 50 is continuously and stably kept. This results in that the mechanical and electrical coupling of the electrical coaxial connector 60 with the mating coaxial connector 70 is surely and stably maintained without being undesirably released.

The locking component 62 provided with the displaceable engaging portion 64 is, for example, formed integrally by the metallic material subjected to cutting processing so as to be caused to engage with the outer peripheral surface of the annular engaging portion 26 of the grounding contact member 21 employed in the connector body 61 and put selectively in the locking state and the non-locking state, and this results in a relatively simple structure of the electrical coaxial connector 60.

Further, on the occasion of causing the locking component 62 to engage detachably with the outer peripheral surface of the annular engaging portion 26 of the grounding contact member 21 employed in the connector body 61 so as to be put in the locking state, a relatively simple operation for causing the locking component 62 to be attached to the annular engaging portion 26 with use of the engaging opening formed between the opposite top ends of the engaging arms 64*a* of the displaceable engaging portion 64 provided on the locking component 62 and to rotate with regard to the annular engaging portion 26 is only required without requiring a considerably large operation force.

The invention claimed is:

1. An electrical coaxial connector comprising;

a connector body including a signal contact member with which a core conductor of a coaxial cable is to be connected and which is caused to be put in contact with a signal contact employed in of a mating coaxial connector, a grounding contact member having an annular engaging portion for engaging with an annular grounding contact employed in the mating coaxial connector and a shell portion extending to be bendable from the annular engaging portion for coming into connection with an outer conductor of the coaxial cable having the core conductor connected with the signal contact member, and a housing member made of insulator for supporting the signal contact member and the grounding contact member in such a manner that the signal contact member and the grounding contact member are insulated from each other, and a locking component made to be separate from the connector body for engaging detachably with an outer peripheral surface of the annular engaging portion of the grounding contact member, wherein the annular engaging portion of the grounding contact member is provided thereon with a slit extending in a direction along an imaginary central axis of the annular engaging portion and further provided on a curved inner surface thereof with an engagement-acting portion for engaging with an engagement-receiving portion provided on a curved outer surface of the annular grounding contact of the mating coaxial connector, wherein the locking component is provided thereon with a displaceable engaging portion which is able to move around the outer peripheral surface of the annular engaging portion of the grounding contact member when the locking component is caused to engage detachably with the outer peripheral surface of the annular engaging portion of the grounding contact member, and wherein the displaceable engaging portion of the locking component is operative to lock the annular engaging portion of the grounding contact member from the outside of the same at a position for closing partially the slit provided on the annular engaging portion of the grounding contact member, so that the annular engaging portion of the grounding contact member is prevented from being subjected to expanding deformation to widen the slit.

2. An electrical coaxial connector according to claim 1, wherein the engagement-receiving portion provided on the curved outer surface of the annular grounding contact employed in the mating coaxial connector is formed to be a groove and the engagement-acting portion provided on the curved inner surface of the annular engaging portion of the grounding contact member employed in the connector body is formed to be a protrusion.

3. An electrical coaxial connector according to claim 1, wherein the engagement-receiving portion provided on the curved outer surface of the annular grounding contact employed in the mating coaxial connector is formed to be a protrusion and the engagement-acting portion provided on the curved inner surface of the annular engaging portion of the grounding contact member employed in the connector body is formed to be a groove.

4. An electrical coaxial connector according to claim 1, wherein the locking component is provided, in addition to the displaceable engaging portion, with a flat portion which is positioned to be close to or in contact with the shell portion of the grounding contact member bent toward the annular engaging portion of the grounding contact member, when the locking component is engaged with the outer peripheral surface of the annular engaging portion of the grounding contact member under a condition wherein the shell portion of the grounding contact member has been bent toward the annular engaging portion of the grounding contact member, and a connecting portion for connecting the flat portion with the displaceable engaging portion.

5. An electrical coaxial connector according to claim 4, wherein the locking component is further provided with a stopper portion projecting from the connecting portion for engaging with a portion of the grounding contact member employed in the connector body so as to prevent the displaceable engaging portion of the locking component from moving excessively along the outer peripheral surface of the annular engaging portion of the grounding contact member when the displaceable engaging portion of the locking component is caused to move around the outer peripheral surface of the annular engaging portion of the grounding contact member.

6. An electrical coaxial connector according to claim 5, wherein the locking component is formed integrally by metallic material subjected to cutting processing.

7. An electrical coaxial connector according to claim 4, wherein the flat portion of the locking component is provided with a groove formed on an outer surface portion thereof, so that the locking component is rotated on the whole when a predetermined driving tool is caused to engage with the groove and rotated in association with the same.

8. An electrical coaxial connector according to claim 4, wherein the locking component is formed integrally by a metallic plate subjected to bending processing.

9. An electrical coaxial connector according to claim 8, wherein the displaceable engaging portion of the locking component is formed to curve along the outer peripheral surface of the annular engaging portion of the grounding contact member employed in the connector body so as to have a pair of engaging arms facing each other.

10. An electrical coaxial connector according to claim 9, wherein an engaging opening is formed between a pair of opposite top ends of the engaging arms of the displaceable engaging portion.

* * * * *